US005674350A

United States Patent [19]

Jurgich

[11] Patent Number: 5,674,350

[45] Date of Patent: Oct. 7, 1997

[54] LABEL DISPENSER AND APPLICATOR ASSEMBLY

[75] Inventor: Donald Jurgich, Poulsbo, Wash.

[73] Assignee: Perl Packaging Systems, L.L.C., Middlebury, Conn.

[21] Appl. No.: 432,978

[22] Filed: May 2, 1995

[51] Int. Cl.[6] ..... B44C 1/165; B65H 29/54

[52] U.S. Cl. ..... 156/540; 156/541; 156/542; 156/DIG. 33; 156/DIG. 37; 271/307

[58] Field of Search ..... 156/540, 541, 156/542, 543, 556, 552, 555, 566, DIG. 28, DIG. 33, DIG. 37, DIG. 41, DIG. 42; 226/96; 271/33, 307, 308, 309, 310, 311

[56] References Cited

U.S. PATENT DOCUMENTS

| | | | |
|---|---|---|---|
| 4,124,429 | 11/1978 | Crankshaw | 156/364 |
| 4,547,250 | 10/1985 | Murayama | 156/384 |
| 4,624,734 | 11/1986 | Voltmer et al. | 156/541 |
| 5,065,896 | 11/1991 | Jurgich | 221/73 |
| 5,501,147 | 3/1996 | Jaffa et al. | 101/118 |

*Primary Examiner*—James Engel.
*Assistant Examiner*—J. A. Lorengo

[57] ABSTRACT

A label dispensing and applicator assembly for use with a roll of backing tapes having labels with pressure-sensitive adhesives on the backside detachably adhering the labels to the backing tape, wherein the assembly includes a label dispensing unit having a label separator mechanism attached to the frame and positioned away from a dispensing strip take-up reel wherein the label separator peels the label from the backing tape as the backing tape moves forwardly over the label separator and abruptly changes direction and extends rearwardly beneath the bar such that the labels are stripped and move forwardly from the label separator. A pair of pinch rollers is rotatably supported by the frame away from the label separator and a pinch roller is positioned to removably receive the dispensing strip therethrough as the dispensing strip is pulled through the label dispensing unit. The pinch roller has a drive belt connected to a conveyor assembly that is positioned forward of the label separator unit. The conveyor assembly includes conveyor belts having a label pickup station adjacent to the label separator and a label dispensing station away from the label separator. The conveyor assembly has a length that allows labels to be picked off of the conveyor belt by hand. The conveyor assembly also includes a dispensing ramp that presents the label adhesive side out for adherence onto a package. A label applicator unit is positionable forward of the label dispensing unit and is adapted to move a container or a package past the dispensing end of the conveyor assembly to securely receive a label thereon.

27 Claims, 9 Drawing Sheets

LABEL DISPENSER AND APPLICATOR ASSEMBLY

TECHNICAL FIELD

The present invention relates to label dispensers in which labels with pressure-sensitive adhesive thereon are stripped from a dispensing tape having a release surface engaged by the adhesive, and the labels are moved to applicators associated with the label dispensers.

BACKGROUND OF THE INVENTION

Labels with pressure-sensitive adhesive thereon for adhering the labels to packages and containers are commonly provided on dispensing rolls of elongated backing tape having a release coating to which the pressure-sensitive adhesive on the labels lightly adheres. The labels are easily stripped from the backing tape prior to being attached to the packages or containers.

As disclosed in my prior U.S. Pat. No. 5,065,896, labels on label dispensing rolls are released from the backing tape by passing the tape over a flat bar at a label releasing station and turning the backing tape in an abrupt turn beneath the underside of the bar. The abrupt turn causes the backing tape to release the leading edge portion of the labels as the labels reach the abrupt turn, because the labels resist the bending necessary to negotiate the turn to an extent that overcomes the adhesive strength of the labels on the release coating of the backing tape.

SUMMARY OF THE INVENTION

There has been a need to provide a simple, relatively inexpensive, portable machine which will deliver the labels from the label releasing station one at a time to a dispensing station in a manner whereby the labels are positioned for application to a flat-sided or round-sided container or package. In accordance with the present invention, as a label moves from the dispensing roll to a label separating unit and the label is released from the backing tape, the label's adhesive side engages a conveyor of a conveyor assembly to which the adhesive on the label lightly adheres. The conveyor preferably comprises two or three parallel-spaced endless plastic belts of round cross-section which pass over sets of sheaves at the label releasing station and a label dispensing station. The conveyor belts are driven by a drive belt connected to a roller that is rotatably driven by length of backing tape under tension being pulled over the roller. Accordingly, the backing tape acts as a drive belt for moving the conveyor.

A label remover is attached to the conveyor assembly at the dispensing station. The label remover defines a sloped ramp that extends upwardly away from the conveyor belts, and the sloped ramp is positioned to engage the label at the dispensing station and lift the label upwardly and forwardly off of the conveyor. Accordingly, the adhesive side of the label is exposed and presented for adhering to a package or container. In the preferred embodiment, the conveyor belts at the label dispensing station pass around dispensing sheaves having elongated cheeks that extend radially past the conveyor belts. The round periphery of the elongated cheeks define the sloped ramp that lifts the conveyed labels from the conveyor belts and presents the adhesive-coated underside of the label forwardly of the discharging sheaves.

Such presentation of the label at the dispensing station facilitates engagement of the label's adhesive coated underside to a package or container moving past the dispensing station. In the preferred embodiment, a pressure roller is tamed by the conveyor assembly adjacent to the dispensing station to press the pressure sensitive adhesive of the label onto the package or container. A label applicator unit of the present invention is constructed to rotate packages or containers forwardly adjacent to the dispensing station. A label presented at the dispensing station of the dispenser unit is moved over the sloped ramp and securely adhered to the rotating package or container. As an alternative, a label can be discharged from the conveyor against a container or package moving past the dispensing station.

DETAILED DESCRIPTION OF THE INVENTION

Figure 1:
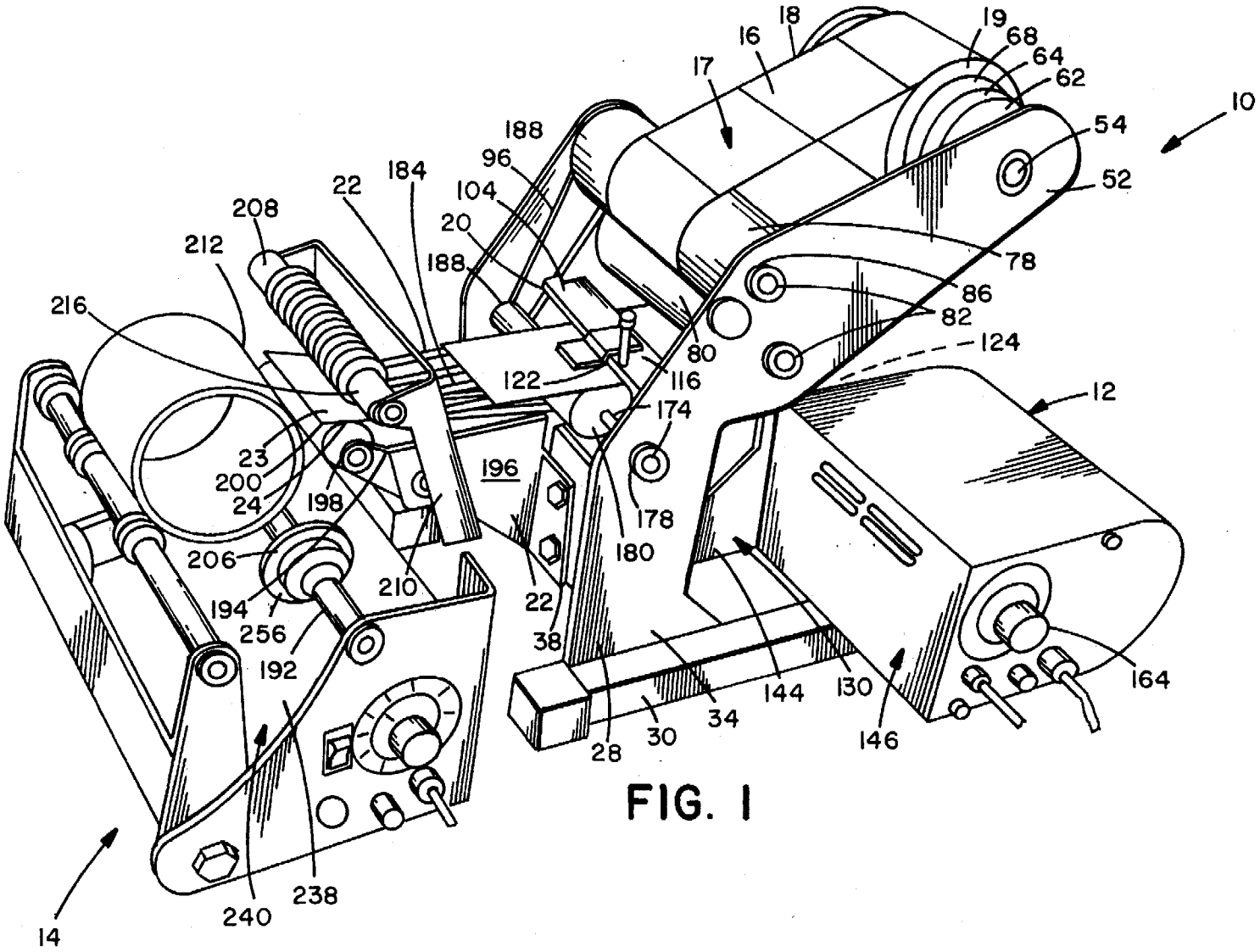
FIG. 1 is an isometric view of the label dispensing assembly in accordance with the present invention, the assembly having a label dispenser unit and a label applicator unit adjacent to the dispenser unit.

A label dispensing assembly 10 in accordance with the present invention is illustrated in FIG. 1. The assembly 10 has a label dispenser unit 12 and a label applicator unit 14 adjustably located adjacent to its forward end. The label dispenser unit 12 pulls a dispensing strip 17, which comprises labels 16 releasably adhered to an elongated backing strip 18, off of a label dispensing roll 19 and around a label separator 20. The labels 16 are peeled off of the backing strip 18 at the label separator and moved onto a conveyor assembly 22, which moves the labels to a dispensing station 23 and over a dispensing ramp 24. The dispensing ramp 24 lifts the labels 16 off of the conveyor assembly 22 and presents the adhesive side of the labels toward a container 26 that is moved past the dispensing station 23 by the label applicator unit 14. The label applicator unit 14 moves the container 26 such that the label 16 is automatically removed from the dispensing station 23 and securely adhered to the surface of the container.

Figure 2:
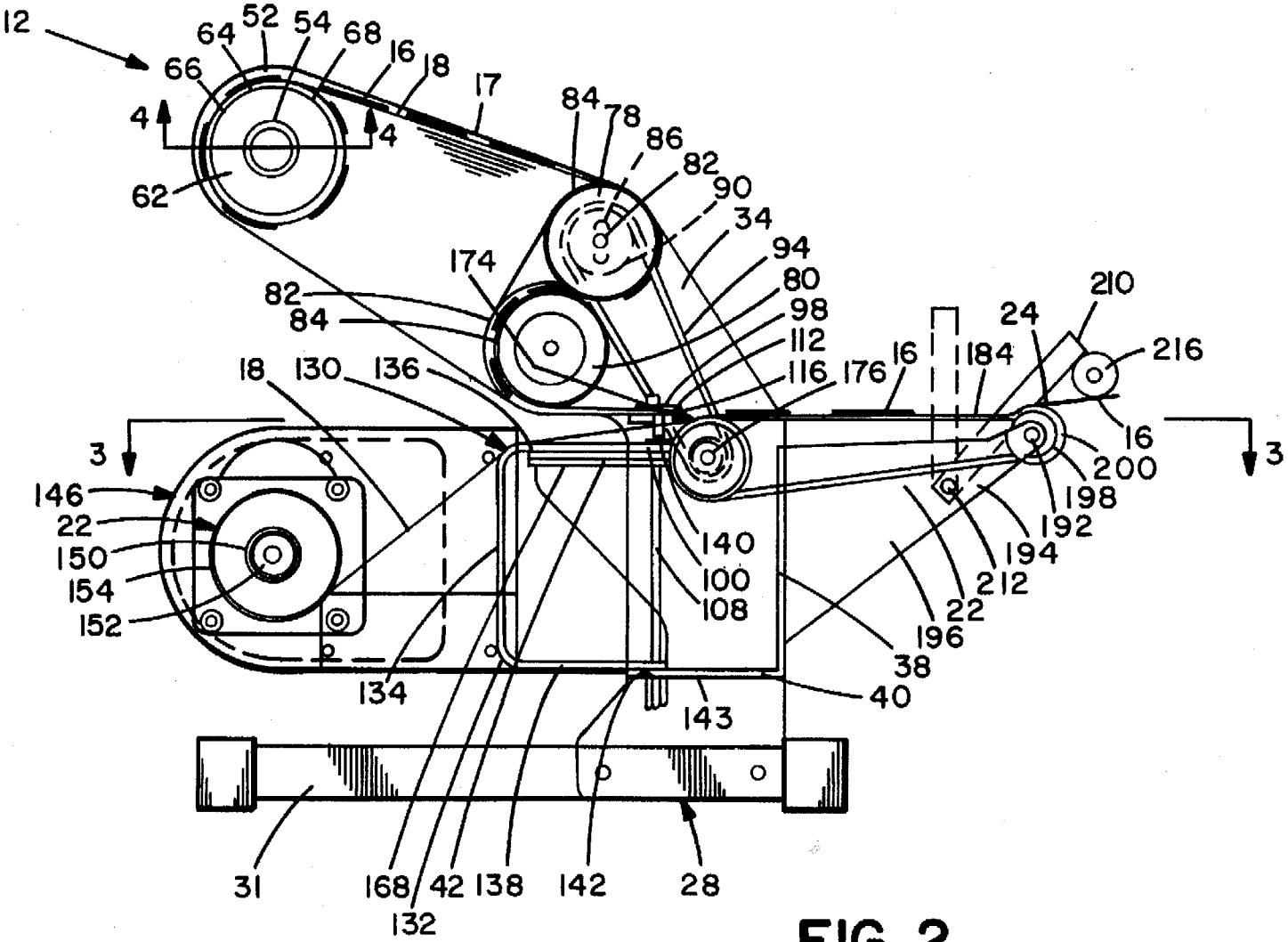
FIG. 2 is a reduced cross-sectional view taken substantially along line 2—2 of FIG. 1 showing the label dispenser unit.
Figure 3:
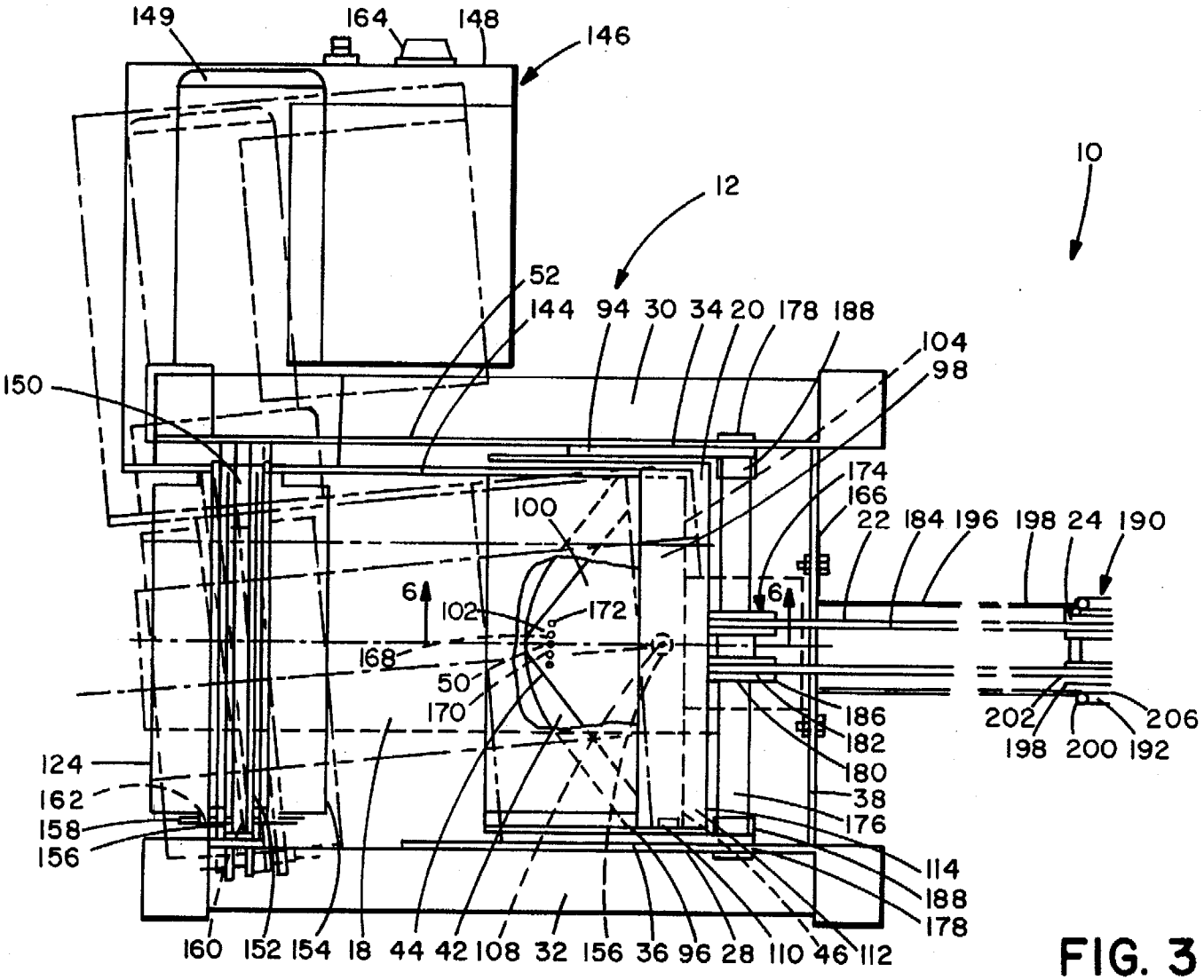
FIG. 3 is an enlarged cross-sectional view taken substantially along line 3—3 of FIG. 2 showing a reel drive, a label separator partially cut away, pinch rollers, a conveyor assembly, and a drive motor, the drive motor and label separator being shown in solid lines in a square position and in phantom lines in an angled position relative to the conveyor assembly.

The label dispenser unit 12 illustrated in FIGS. 1, 2, and 3 is a portable unit that includes a frame 28 having left and right bottom support rails 30 and 32 which are positionable on a support surface such as a table or the like for operation of the label dispenser unit. The left and right bottom support rails 30 and 32 are rigidly attached to bottom ends of upstanding left and right side plates 34 and 36 interconnected by a front mounting plate 38 extending therebetween. A horizontal bottom shelf 40 shown in FIG. 2 extends between the left and right support plates 34 and 36 and connects at its forward edge to the front mounting plate 38. A horizontal top shelf 42 spaced above the bottom shelf 40 extends between and rigidly attaches to the left and right side plates 34 and 36. As best seen in FIG. 3, the top shelf 42 has a generally triangular shape with an apex portion 44 between the left and right support plates 34 and 36 such that the apex portion points away from the front mounting plate 38. Opposite the apex portion 44 is a leading edge 46 of the top shelf that is at a slightly elevated position above the apex portion and is located at approximately the same height as the upper edge 48 of the front mounting plate 38. The top shelf 42 pivotally supports the label separator rearwardly adjacent to the conveyor assembly 22.

The left side plate 34 has an upper portion 52 that extends upwardly and rearwardly from the top shelf 42. The upper portion 52 rigidly supports a cantilevered takeoff shaft 54 that extends to the right away from the left side plate 34 terminates at its right end 56. The takeoff shaft's right end 56 is externally threaded to removably receive a nut 60 that retains a rotatable takeoff spool assembly 62 carried by the takeoff shaft 54.

Figure 4:
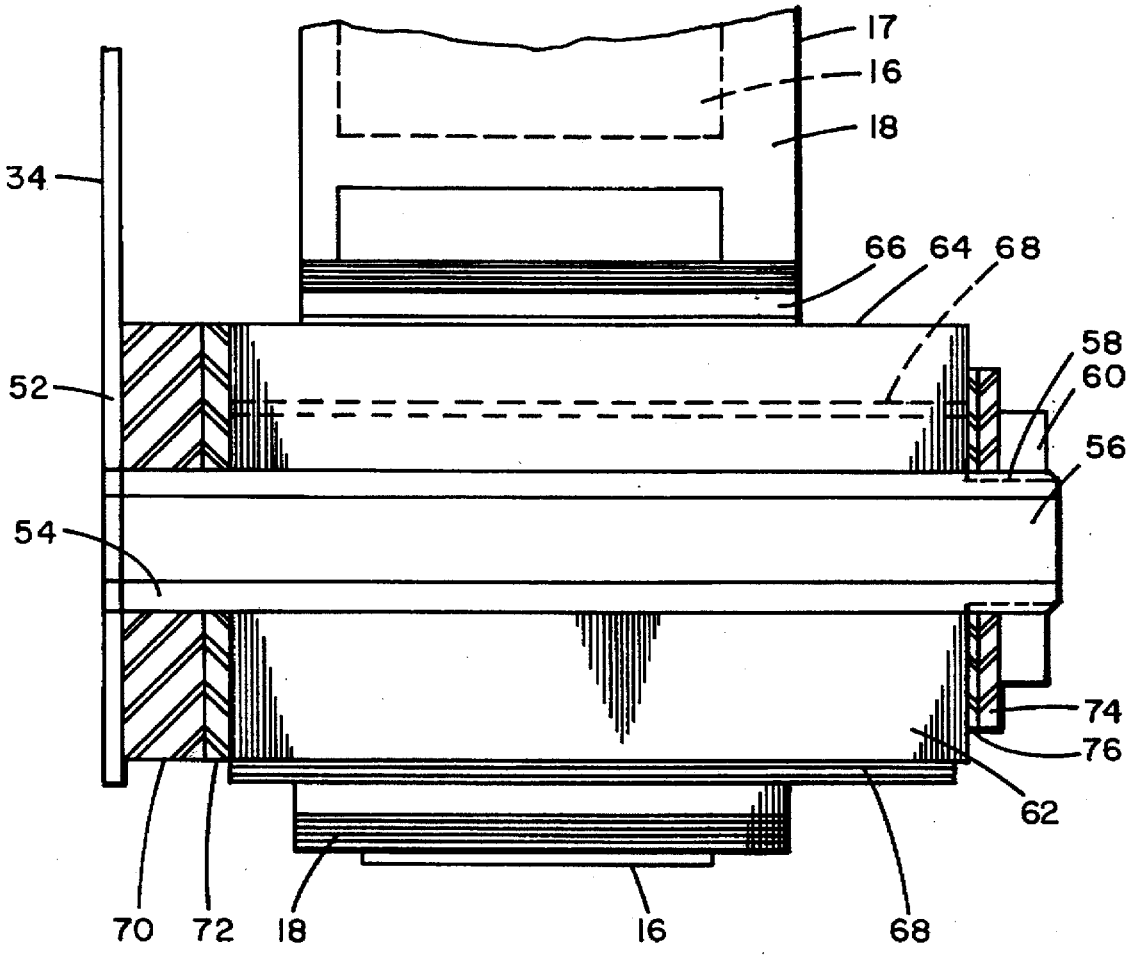
FIG. 4 is an enlarged cross-sectional view taken substantially along line 4—4 of FIG. 2 showing a take-up roller mounted on the frame.

As best seen in FIG. 4, the takeoff spool assembly 62 has a substantially cylindrical drum 64 with exterior spacer rods 68 thereon. The drum 64 is sized to fit axially within the dispensing roll 19 and the spacer rods 68 exert a radial force on the dispensing roll to securely retain the dispensing roll on the drum. Accordingly, the drum 64 and the dispensing roll 19 rotate as a unit about the takeoff shaft 54.

Rotation of the drum 64 and dispensing roll 19 is resisted by an adjustable drag force. The drag force is generated by a compressible foam disk 70 of the takeoff spool assembly 62 that is located on the takeoff shaft 54 immediately adjacent to and in engagement with the left side plate 34. The foam disk 70 sandwiches a rubber left drag ring 72 against the left side of the drum 64. The foam disk 70 and the left drag ring 72 are generally non-rotatable about the takeoff shaft 54 and the left drag ring creates frictional drag that resists rotation of the drum 64 and the attached dispensing roll 19. Additional rotational drag is generated by a right drag ring 76 that is sandwiched between the right end of the drum 64 and a washer 74, which is immediately adjacent to the nut 60. The extent of frictional drag and the resulting rotational resistance depends upon the normal forces exerted between the left and right drag rings 72 and 76 and the drum 64. The normal forces are increased or decreased by adjusting the nut 60 on the external thread 58 of the takeoff shaft 54. The washer 74 has a key that extends into a keyway in the external threads of the takeoff shaft 54 to prevent the washer from rotating about the shaft and inadvertently tightening the nut 60. The foam disk 70 is compressed when the nut 60 is tightened such that the resulting normal forces and the resulting rotational resistance are easily controllable by tightening or loosening the nut by hand.

The resistance to rotation of the drum 64 and attached dispensing roll 19 is overcome by pulling axially on the dispensing strip 17, whereby the dispensing roll will rotate with the drum 64 and the backing strip 18 and the labels 16 will unroll from the dispensing roll. As the backing strip 18 and labels 16 lightly adhered thereon are unrolled from the dispensing roll 19, the rotational resistance maintains tension in the dispensing strip 17 as it extends away from the dispensing roll. Accordingly, the tension in the dispensing strip 17 during operation of the label dispenser unit 12 is controllable by adjusting the nut 60 on the takeoff shaft 54.

Figure 7:
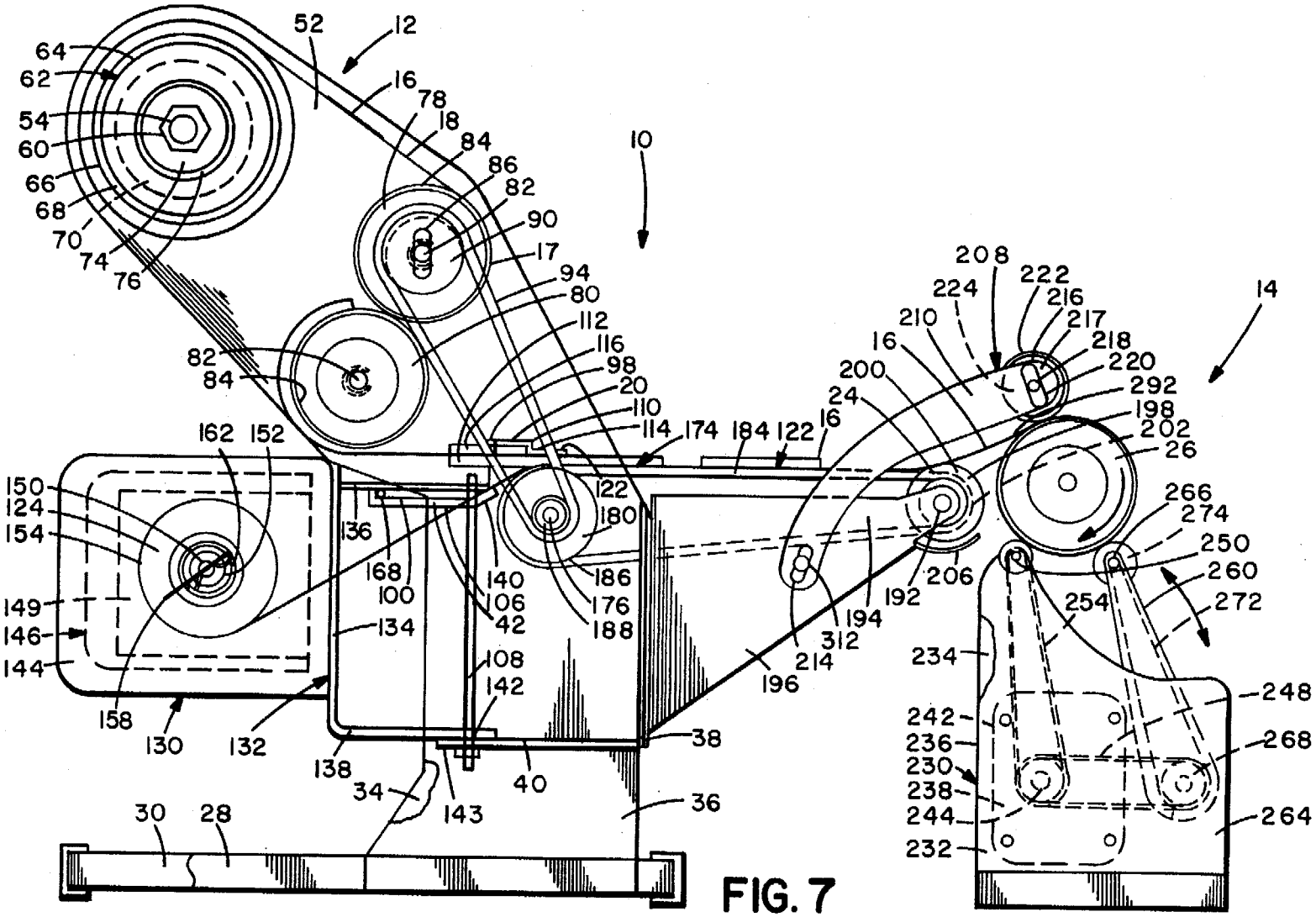
FIG. 7 is an enlarged side elevation view of the label dispenser unit of FIG. 1, the unit being shown with a right side plate removed for purposes of clarity, the unit having an alternate embodiment of a pressure bar assembly.

As best seen in FIGS. 2 and 7, the dispensing strip 17 extends forwardly from the top of the dispensing roll 19 and wraps around upper and lower pinch rollers 78 and 80 that are rotatably supported adjacent to each other by the left and right side plates 34 and 36. The upper and lower pinch rollers 78 and 80 each have a drum 84 that is rotatably carded by an axle 82 extending between the left and right side plates 34 and 36. The dispensing strip 17 wraps around the pinch rollers 78 and 80 in a generally S-shaped path extending forwardly over the top of the upper pinch roller 80, and rearwardly between the upper and lower pinch rollers and forwardly under the bottom of the lower pinch roller. The upper pinch roller 78 pinches or presses the labels 16 and dispensing strip 17 against the top of the lower pinch roller 80. Accordingly, the dispenser strip 17 is pinched between the upper and lower pinch rollers, so that the pinch rollers roll relative to the side plates 34 and 36 when the dispensing strip, which is under tension, is pulled along the S-shaped path. As a result, the dispensing strip 17 acts as a drive belt to rotate the upper and lower pinch rollers 78 and 80.

In the preferred embodiment, an arcuate guide plate 81 extends between the left and right side plates 34 and 36 rearwardly adjacent to the lower pinch roller 80. The guide plate 81 guides the dispensing strip 17 around the lower pinch roller and provides protection to the dispensing strip during operation of the label dispensing unit 12. The axle 82 of the lower pinch roller 80 is securely attached at its ends to the left and fight side plates 34 and 36 such that the axle of the lower pinch roller is substantially fixed relative to the sideplates.

The outer ends of the upper pinch roller's axle 82 extend through vertically aligned slots 86 in the left and right side plates 34 and 36 such that the upper pinch roller is movable vertically relative to the sideplates. The upper pinch roller 78 is positioned with the drum 84 pressing by the force of gravity against the drum of the lower pinch roller 80 when the upper pinch roller's axle 82 is in an intermediate position along the length of the slots 86. Accordingly, gravity presses the upper pinch roller 78 downwardly toward the lower pinch roller to pinch the dispensing strip therebetween. This vertically movable upper pinch roller 78 allows the same upper and lower pinch rollers 78 and 80 to be used with dispensing strips having a wide range of thickness. The movable upper pinch roller 78 also makes threading the dispenser strip between the pinch rollers very easy.

The upper pinch roller 78 includes drive belt sheaves 90 attached to the left and right ends of the drum 84 inwardly adjacent to the respective left and right side plates 34 and 36. The drive belt sheaves 90 which are fixedly attached to the dram 84 rotate with the drum when the dispensing strip 17 moves and rotates the pinch rollers. In the preferred embodiment, the drive belt sheaves 90 each receive an endless conveyor drive belt 94 that has a substantially circular cross-section. The conveyor drive belts 94 extend around the drive belt sheaves 90 and operatively attach to the conveyor assembly 22 so as to chive the conveyor assembly and move labels 16 to the dispensing station 23, as discussed in greater detail below. The preferred conveyor drive belts 94 are constructed of plastic material having a coefficient of friction that substantially resists slipping around the drive belt sheaves 90 to efficiently convert the rotational movement of the upper pinch roller 78 to axial movement of the conveyor assembly 22. The conveyor drive belts 94 exert a downward force on the upper pinch roller 78 to create additional friction between the upper and lower pinch rollers 78 and 80 and additional friction on the dispensing strip moving over and between the pinch rollers.

As best seen in FIGS. 2 and 7, the dispensing strip 17 extends forwardly from the bottom of the lower pinch roller 80 toward the conveyor assembly 22 and wraps around the label separator 20. The label separator 20, illustrated in FIGS. 3, 5, and 6, includes a generally triangular lower support plate 100 with an apex portion 102 spaced above the apex portion 44 of the frame's top shelf 42 (FIGS. 3 and 6). Opposite the apex portion 102 of the lower support plate 100 is a leading edge portion 104 that is substantially aligned with the leading edge 46 of the top shelf 42. The leading edge portion 104 of the lower support plate 100 has a registering hole 106 along its center line above a corresponding registering hole 107 in the frame's top shelf 42. The lower support plate 100 is securely and pivotally attached to the frame's top shelf 42 by a pivot rod 108 that extends through the aligned registering holes 106 and 107.

The label separator 20 also includes a pair of end posts 110 projecting upwardly from the outer ends of the lower support plate 100. The end posts 110 which are adjacent to the leading edge 104 of the lower support plate 100 support a label separating plate 112 spaced above the leading edge of the lower support plate. In the preferred embodiment, the lower support plate 100, the end posts 110, and the label separating plate 112 are rigidly interconnected, such as by welding or the like, to form a solid unit.

As best seen in FIGS. 2 and 7, the label separating plate 112 is positioned forward of the lower pinch roller 80 and is at a height slightly below the bottom of the lower pinch roller. The dispensing strip 17 extends forwardly from the bottom of the lower pinch roller 80 and over the top of the label separating plate 112. The forward portion of the label separating plate 112 includes separating edge 114 above and forward of the leading edge portion 104 of the lower support plate 100. The separating edge 114 is shaped to receive the dispensing strip 17 therearound such that the dispensing strip's backing strip 18 extends forwardly over the top of the separating plate 112 and abruptly changes direction by wrapping over the separating edge and extending rearwardly below the separating plate through the space between the separating plate and the lower support plate 100.

When the dispensing strip 17 is pulled over the label separating plate 112 and the backing strip 18 makes the abrupt turn over the separating edge 114, the labels 16 are peeled off of the backing strip. The labels 16 resist the bending that is necessary to negotiate the change of direction over the separating edge 114, and the label's resistance to bending is greater than the adherence of the adhesive side of the label to the release coating on the backing strip. As a result, the separating unit 20 separates the components of the dispensing strip 17. The backing strip 18 wraps around the separating edge 114 and extends rearwardly away from the conveyor assembly, and the labels 16 peel off, leading edge first, from the backing strip with the adhesive side facing down, and the labels continue forwardly from the separating edge 114 toward the conveyor assembly 22. The removed label 16 is then received on the conveyor assembly 22 at a pickup station 174 and conveyed forwardly away from the label separating plate 112.

Figure 5:
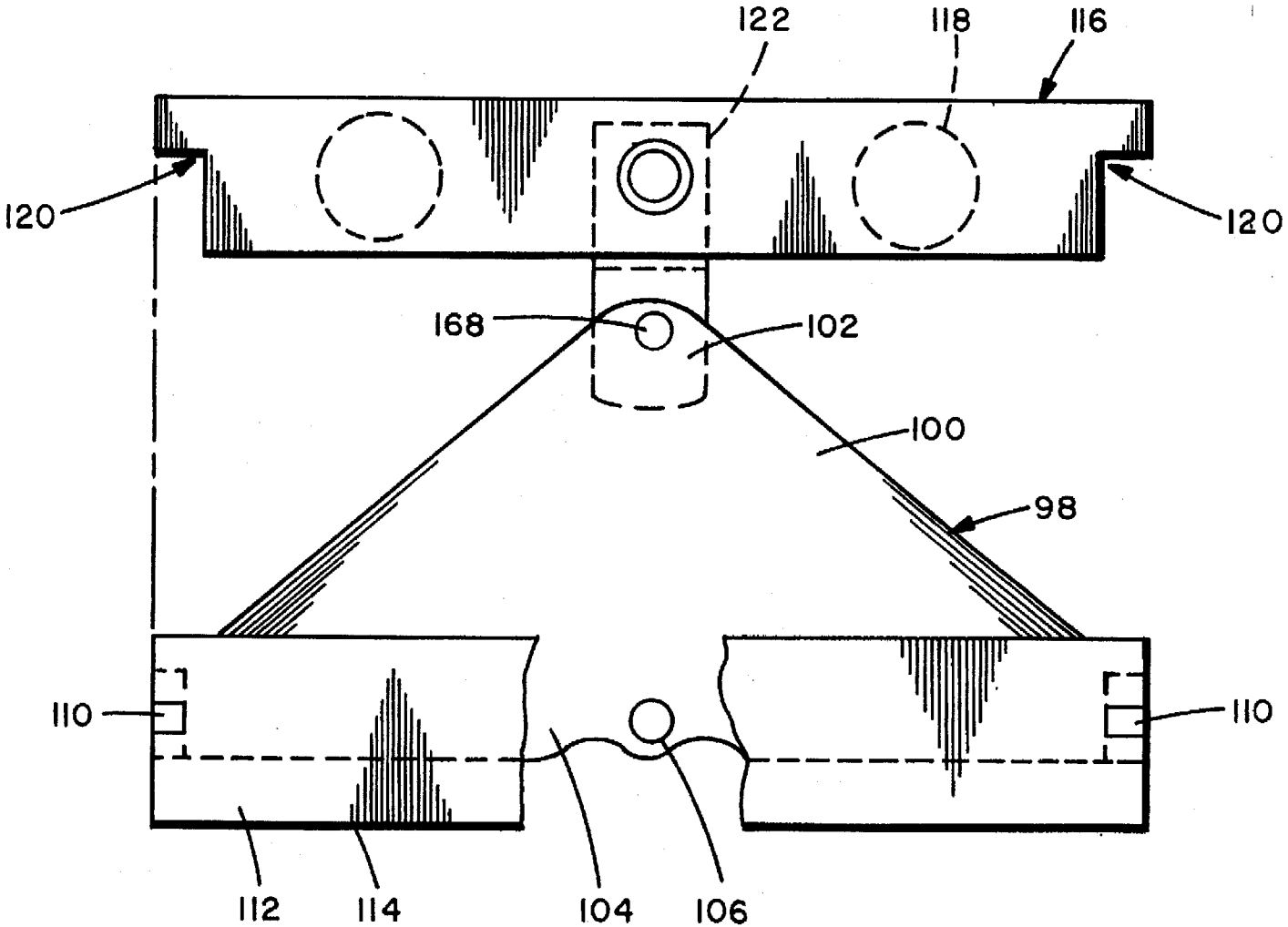
FIG. 5 is an enlarged exploded top view of the label separated plate of FIG. 3 removed from the frame.
Figure 6:
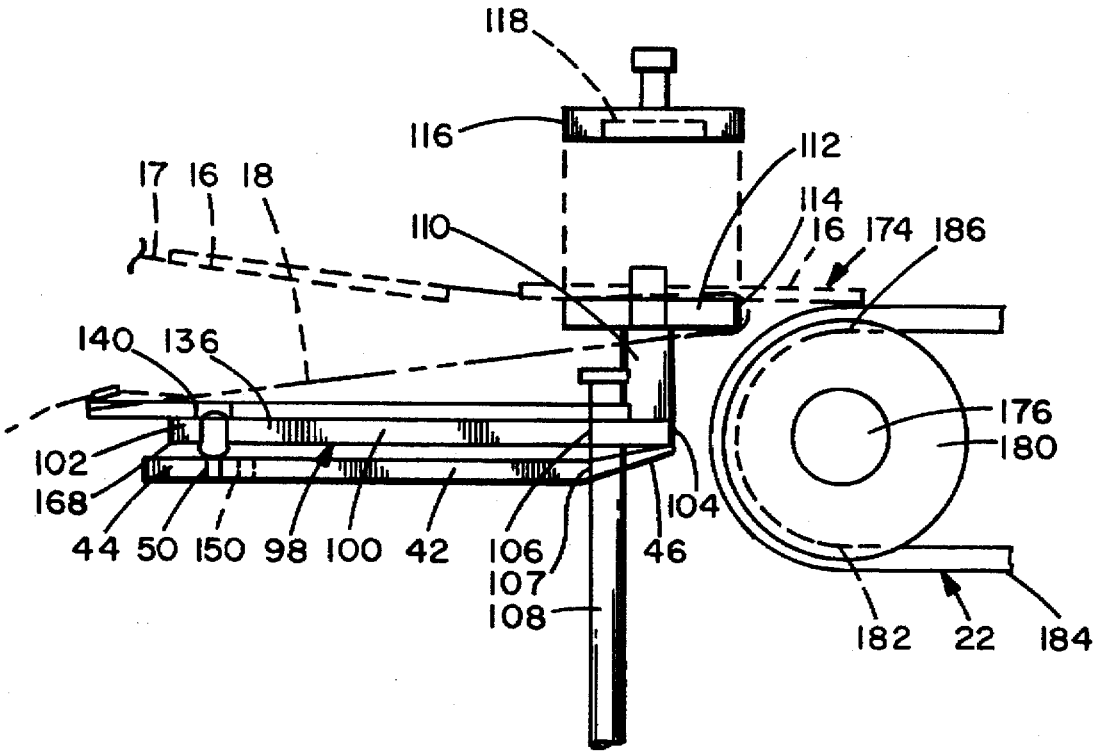
FIG. 6 is a partially exploded cross-sectional view taken substantially along line 6—6 of FIG. 3 showing the label separator attached to the frame and to a swing frame.

As best seen in FIGS. 5 and 6, the top of the label separating plate 112 and the end posts 110 removably receive a hold-down bar 116 that sandwiches the dispensing strip 17 therebetween before the dispensing strip is separated. The hold-down bar 116 is removably retained on the label separating plate 112 by a pair of magnets 118 within the hold-down bar. However, other retaining devices can be used to removably retain the hold-down bar 116 on the label separating plate 112. The hold-down bar 116 has a pair of notches 120 in their outer ends that receive the end posts 110 such that the end posts block the hold-down bar 116 from moving over the top of the separating plate 112 as the dispensing strip 18 is pulled over the separating plate.

The hold-down bar 116 presses downwardly against the label separating plate 112 and sandwiches the dispensing strip 17 therebetween such that a label 16 and a section of the backing strip 18 are pressed substantially flat just before the separating edge 114. The hold-down bar 116 prevents the dispensing strip 88 from arching upwardly before the separating edge 114 and allowing the label to begin to follow the backing strip around the separating edge. Accordingly, the hold-down plate 116 facilitates in removal of thin, flexible labels, such as Mylar™ labels or the like, that may have a sufficient flexibility to follow the backing strip around the separating edge 114.

As best seen in FIGS. 5 and 7, a pressure plate 122 is adjustably attached to the top of the hold-down bar 116 and is contoured to provide a pressure surface that engages the label 16 as it is removed from the backing strip 18. The pressure plate 122 presses the removed label downwardly into engagement with the conveyor assembly 22 such that the label is lightly adhered to the conveyor assembly. The pressure plate 122 is particularly affective when the labels 16 being dispensed are the thin, lightweight labels to ensure the labels sufficiently engage the conveyor assembly 22. When the labels are such that light adhesion between the label and the conveyor assembly is accomplished without additional downward pressures needed, the pressure plate 122 can be removed from the hold-down bar 116, or the hold-down bar can be removed from the separating plate 112.

After the labels 16 have been separated from the backing strip 18, as best seen in FIGS. 2 and 7, the backing strip extends rearwardly and wraps around a driven take-up spool 124. The end of the backing strip 18 is securely connected to the take-up spool 124 by, as an example, taping the end onto the spool with a label or otherwise securing the end to the take-up spool. The take-up spool 124 is rotated so the backing strip 18 wraps around the take-up spool 124 from the bottom. This wrapping of the backing strip 18 around the take-up spool 124 pulls on the backing strip, thereby pulling on the dispensing strip 17 and causing it to unroll from the dispensing roll 19, move around and drive the pinch rollers, and move over the label separating plate 112.

As best seen in FIGS. 2 and 3, the take-up spool 124 is rotatably attached to a swing frame assembly 130 that is pivotally mounted to the top and bottom shelves 42 and 40 of the frame 28. The swing frame assembly 130 has a generally U-shaped frame member 132 defined by a generally vertical web 134 and upper and lower flanges 136 and 138 extending forwardly from the web. The upper flange 136 is seated on top of the lower support plate 100 of the label separator 20 and is pivotally retained thereon by the pivot rod 108 that extends through a registering hole 140 in the forward edge portion of the upper flange. Accordingly, the apex portion 102 of the lower support plate 100 is sandwiched between the upper flange 136 and the apex portion 44 of the top shelf 42. The registering hole 140 is coaxially aligned with the registering holes 106 and 107 in the lower support plate 100 and the top shelf 42, respectively, and the pivot rod 108 extends through the registering holes, so the upper flange 136 and the label separator 20 are pivotal about the pivot rod relative to the top shelf 42 between a plurality of angular orientations.

The lower flange 138 of the swing frame assembly 130 extends forwardly from the web 134 and overlaps the bottom shelf 40 of the frame 28. The lower flange 138 and the bottom shelf 40 each have registering holes 142 and 143 that are coaxially aligned with each other and with the registering holes 140, 106 and 107 of the upper flange 136, the lower support plate 100, and the top shelf 42, respectively. The pivot rod 108 extends through the registering holes 142, 143, 140, 106, and 107 and is securely retained therein by a fastener or other suitable holding device. Accordingly, the entire U-shaped frame member 132 is pivotal relative to the top and bottom shelves 42 and 40 of the frame 28.

The swing frame assembly 130 has a mounting plate 144 that is securely attached to the left side of the U-shaped frame member 132 and that extends rearwardly away from the frame member. The mounting plate 144 supports a drive motor assembly 146 that projects outwardly opposite the take-up spool 124. The drive motor assembly 146 includes a motor housing 148 surrounding a variable speed, DC drive motor 149. The drive motor 149 has a drive shaft 150 that extends through the mounting plate away from the motor housing 148. The drive shaft 150 removably receives the take-up spool 124 so the take-up spool and the drive shaft are coaxially aligned and positioned below the takeoff spool assembly 62.

The take-up spool 124 includes a hollow take-up shaft 152 extending over the drive shaft 150, and an outer drum 154 that is coaxially aligned and securely attached to the take-up shaft 152. As illustrated in FIGS. 3 and 7, an outer end 156 of the drive shaft 150 projects outwardly from the end of the take-up shaft 152. The drum 154 and take-up shaft 152 are securely retained on the drive shaft 150 by a retaining pin 158 that extends through an aperture 160 in the outer end 156 of the drive shaft. Removal of the drum 154 is accomplished by removing the retaining pin and sliding the drum axially off of the drive shaft 150.

In the preferred embodiment, the retaining pin 158 extends through a key way 162 in the fight side of the drum 154, thereby interconnecting the rotatable drive shaft 150 and the drum 154. Upon rotation of the drive shaft 150, the retaining pin 158 engages the drum 154 and causes the drum to rotate with the drive shaft. The rotational speed of the drum 154 is controlled by adjusting the speed of the drive shaft 150, which is controlled by a variable speed control 164 operatively connected to the drive motor 149.

When a user activates the drive motor 149 and causes the drive shaft 150 to rotate, the take-up spool 124 is driven and the backing strip 18 wraps around the drum 154, thereby maintaining tension in the dispensing strip 17 as it moves around the upper and lower pinch rollers 78 and 80. In the preferred embodiment, the retaining pin 158 engages the drum 154 to interconnect and operatively connect the drive shaft 150 to the drum such that they rotate together upon activation of the drive motor 149. However, other securing mechanisms can be used to interconnect the drum 154 and the drive shaft 150.

As best seen in FIG. 3, the swing frame assembly 130 and the drive motor assembly 146 thereon is pivotal relative to the frame 28 about the pivot rod 108 between a plurality of angular orientations. The swing frame assembly 130 pivots with the label separator 20 relative to the frame's top shelf 42 such that the label separating edge 114 of the label separating plate 112 is movable between a plurality of angular orientations. Accordingly, the label separating edge 114 is angularly adjustable relative to the leading edge of the label 16 being stripped from the backing strip 18. When the separator 20 is moved to a selected angular position and the dispensing strip 17 is pulled over the angled separating plate 112, each label moves over the separating plate so a leading comer portion 166 of each label is peeled off of the backing strip first and the remainder of the label is sequentially peeled off as the backing strip 18 is pulled around the separating edge 114. Such pivotal positioning of the swing frame assembly 130 and the label separator 20 is particularly effective to peel the leading comers 166 of thin flexible labels, such as Mylar™ labels having a thickness of 0.001 inches without requiting additional masking on the thin labels that is often used to increase the thin label's resistance to bending with the backing strip around a stripping mechanism. It is also effective to peel labels 16 from the backing strip when, as an example, a cut has been inadvertently made in the backing strip, thereby peeling the label's comer opposite the cut so as to avoid tipping the backing strip.

The swing frame assembly 130 and the label separator 20 are retained in a selected one of a plurality of angular orientations relative to the frame 28 by a detent 168, such as a ball detent or the like, positioned at the apex portion 102 of the lower support plate 100 between the corresponding apex portion 44 of the frame's top shelf 42 and the upper flange 136 of the U-shaped member. The detent 168 is positioned in an aperture in the apex portion 102 of the lower support plate 100. A plurality of alignment holes 170 are formed in the apex portion 44 of the top shelf 42 including an alignment hole along the centerline of the top shelf and alignment holes positioned on left and tight sides of the centerline of the top shelf. The top shelf's alignment holes 170 are positioned to removably receive the detent 168 therein thereby releasably retaining the label separator in the selected angular orientation relative to the frame.

The upper flange 136 of the U-shaped frame member 132 has a plurality of alignment holes 172 therein that removably receive the detent 168 upon pivoting the swing frame assembly 130 to selected angular positions. Accordingly, the label separator 20 and the swing frame assembly 130 can be retained in a selected one of a plurality of angular positions relative to the frame's top shelf 42. In the preferred embodiment, the swing frame assembly 130 also moves relative to the label separator 20 as the detent 168 is positioned in the different alignment holes 172 in the upper flange 136. The detent 168 of the preferred embodiment is positionable in the alignment holes 170 and 172 such that the detent removably retains the label separator in one of a plurality of angular orientations that defines an angle in the range of zero to ±20° between the leading edge 104 of the lower support plate 100 and the leading edge 46 of the top shelf 42. As best seen in FIG. 5, the leading edge portion 104 of the lower support plate 100 includes rearwardly recessed portions 173 that are positioned to avoid interference between the lower support plate and the conveyor assembly 22 when the label separator 20 is pivoted between the angular orientations.

As best seen in FIGS. 3 and 7, the conveyor assembly 22 is positioned forwardly of the label separator so a pickup station 174 of the conveyor assembly receives the labels 16 as they are peeled from the backing strip 18. The conveyor assembly 22 has a rear conveyor shaft 176 extending between the left and right side plates 34 and 36 and securely retained in the side plates by a pair of bearings 178. The bearings 178 allow the rear conveyor shaft 176 to rotate substantially freely relative to the frame 28. The rear conveyor shaft 176 is a substantially horizontal shaft having a plurality of rear conveyor sheaves 180 mounted thereon in a spaced-apart relation. Each of the rear conveyor sheaves 180 has an annular groove 182 that receives a portion of an endless conveyor belt 184. In the illustrated embodiment of FIG. 3, two endless conveyor belts 184 extend around a corresponding pair of rear conveyor sheaves 180. In the embodiment illustrated in FIG. 1, four endless conveyor belts 184 are provided that extend around a corresponding set of four rear conveyor sheaves 180. In an alternate embodiment not illustrated, the conveyor assembly 22 has three endless conveyor belts 184.

In an alternate embodiment, illustrated in FIG. 3, the conveyor assembly 22 is an elongated structure having endless conveyor belts 184 that are adapted to simultaneously carry several labels 16 along the conveyor belts toward the forward end of the conveyor assembly. The labels 16 are easily accessible to a person as the labels travel toward the forward end so the person or persons can pick labels off of the conveyor belts by hand at any point along the length of the conveyor belts and attach them to a package or the like. The conveyor assembly 2 can be constructed to have a short conveyor length in the range of three inches, or a long conveyor length in the range of 20 inches or more.

The rear conveyor sheaves 180 each have a pair of cheeks 186 that extend radially from the rear conveyor shaft 176 such that the annular groove 182 is between the cheeks. The conveyor belts 184 fit in the respective annular grooves 182 and extend radially above the outer surface of the cheeks 186. The conveyor belts 184 are at approximately the same height as the label separating plate 112 to receive the labels 16 peeled from the backing strip 18. The conveyor belts 184 are preferably constructed of a plastic material to which the adhesive side of the label will only lightly adhere so the labels can be easily removed from the conveyor belts. However, other conveyor belt materials or arrangements can be used to effectively convey the peeled labels 16 forwardly toward the label dispensing station 23.

The rear conveyor shaft 176 is driven by a pair of drive belt sheaves 188 at the shaft's left and fight ends that each receive a conveyor drive belt 94 extending around the drive belt sheaves 90 of the upper pinch roller 78. The rear conveyor shaft 178 and the rear conveyor sheaves 180 are, thus, rotatably driven relative to the frame 28 by the conveyor drive belts 94 which are, in turn, driven by the upper pinch roller 78. As discussed above, the upper pinch roller 78 is driven by the dispensing strip 17 which is under constant tension created by the takeoff spool assembly 62.

The drive belt sheaves 188 on the rear conveyor shaft 176 have a diameter that is greater than the diameter of the drive belt sheaves 90 on the upper pinch roller 78 such that a gearing arrangement is created to cause the conveyor belts 184 to move at a speed greater than the speed at which the backing strip 18 and labels 16 are moving. This difference in the speed of the conveyor belts 184 versus the speed of the labels 16 causes the labels to be separated from each other when they move onto the conveyor belts. Therefore, labels 16 can be positioned on the backing strip 16 immediately adjacent to each other, as is the case when the labels are separated by a die cut, and the labels will be moved apart from each other upon being picked up by the conveyor assembly 22 at the pickup station 174.

As best seen in FIGS. 1, 2 and 7, the conveyor belts 184 extend forwardly from the pick-up station 174 toward the dispensing station 23 of the conveyor assembly 22. The conveyor assembly 22 includes a forward conveyor shaft 192 at the dispensing station 23, and the forward conveyor shaft 192 is rotatably carried by opposing bracket arms 194 of a conveyor support structure 196 securely attached to the front mounting plate 38 of the frame 28. The forward conveyor shaft 92 carries forward conveyor sheaves 198 in a spaced-apart relation to maintain a desired spacing between the conveyor belts 184.

Each of the forward conveyor sheaves 198 include a pair of elongated cheeks 200 that extend radially from the forward conveyor shaft 192 to define an annular groove 202 between the extended cheeks. Each of the conveyor belts 184 extends around a respective forward conveyor sheaf 198 and is positioned in the annular groove 202 such that the extended cheeks 200 are positioned radially above the uppermost surface of the conveyor belt. Accordingly, the extended cheeks 200 define the label dispensing ramp 24 over which the label 16 on the moving conveyor belts 184 pass as the label moves along the dispensing station 23. In the preferred embodiment, the extended cheeks 200 are constructed of a material such as Teflon™ or the like, to which the adhesive on the label will not stick, thereby facilitating easy removal of the label from the dispensing ramp.

The dispensing ramp 24 at the dispensing station 23 provides a label removing device that receives the leading edge of the label 16 being conveyed to the dispensing station, and the ramp lifts the adhesive surface of the label upwardly off of the conveyor belts 184 and directs the label upwardly and forwardly away from the conveyor belts with the adhesive side of the label being exposed and presented for application onto a label surface of a container moving past the dispensing station.

The conveyor support structure 196 has a protective plate 206 extending between the bracket arms 194 below the forward conveyor sheaves 198. The protective plate 206 is positioned to protect the forward conveyor sheaves 198 from being impacted or the like by a package or container moving past the dispensing station 23.

As best seen in FIGS. 1, 2 and 7, a pressure bar assembly 208 is adjustably connected to the bracket arms 194 and is positioned to provide a compressive force against the label after the label has been presented and attached to the container 26. The pressure bar assembly 208 has a pair of support arms 210 that are pivotally attached to rearward ends of the bracket arms by a pivot pin 212 extending therebetween, such that the pressure bar assembly can be adjusted between operating positions for different sized containers shown in solid and phantom lines in FIG. 2. The pressure bar assembly 208 can also be manually raised out of engagement with the container, as in shown in FIG. 1, for example, before beginning a labeling operation to properly adjust the position of the assembly as is needed for the selected labeling operation.

The support arms 210 have a pair of opposing slots 214 therein through which the pivot pin 212 extends. The slots 214 provide for adjustment of the position of the support arms relative to the dispensing station 23 of the conveyor assembly 22 to accommodate containers having different sizes or shapes. In addition, the support arms 210 pivot about the pivot pin to adjust the position of the pressure bar 216 to accommodate containers of different sizes or shapes. In the preferred embodiment, the pivot pin 212 is a bolt that can be tightened so as to secure the support arms 210 in a selected position relative to the dispensing station 190.

A pressure bar 216 is rotatably supported between the support arms 210 at their outer ends 217 away from the pivot pin 212. As best seen in FIG. 7, the pressure bar 216 includes an axle 218 that extends through elongated slots 220 in the outer ends 217 of the support arms 210 such that the ends of the pressure bar's axle 218 are movable along the length of the slots. Accordingly, the pressure bar 216 is movable relative to the support arms 210 to allow the pressure bar to be moved into engagement with the container 26 during a labeling operation. The pressure bar 216 engages the container 26 in a manner such that the label 16 being attached to the container will adhere to the container and the moving container pulls the label off of the dispensing ramp 24 and moves the label under the pressure bar. The pressure bar 216 exerts pressure on the label 16 and securely adheres the pressure sensitive adhesive backing to the label onto the label portion 292 of the container 26.

In the preferred embodiment, the pressure bar 216 includes rubber rings 222 extending around a weighted cylinder 224. The rubber rings 222 engage the container 26 and the label 16 such that the pressure bar rotates about the axle 218 and rolls over the label to obtain even pressure distribution on the label to press it against the container.

In one embodiment, the container 26 is moved relative to the pressure bar assembly 208 and the dispensing station 23 of the dispensing unit 12 by the label applicator unit 14 as shown in FIGS. 1 and 7. The label applicator unit 14 is adapted to spin substantially cylindrical containers at a position adjacent to the dispensing station 23 such that a label 16 moving over the dispensing ramp 24 of the dispensing station is adhered to the container 26 and pressed into secure engagement by the pressure bar 216.

Figure 8:
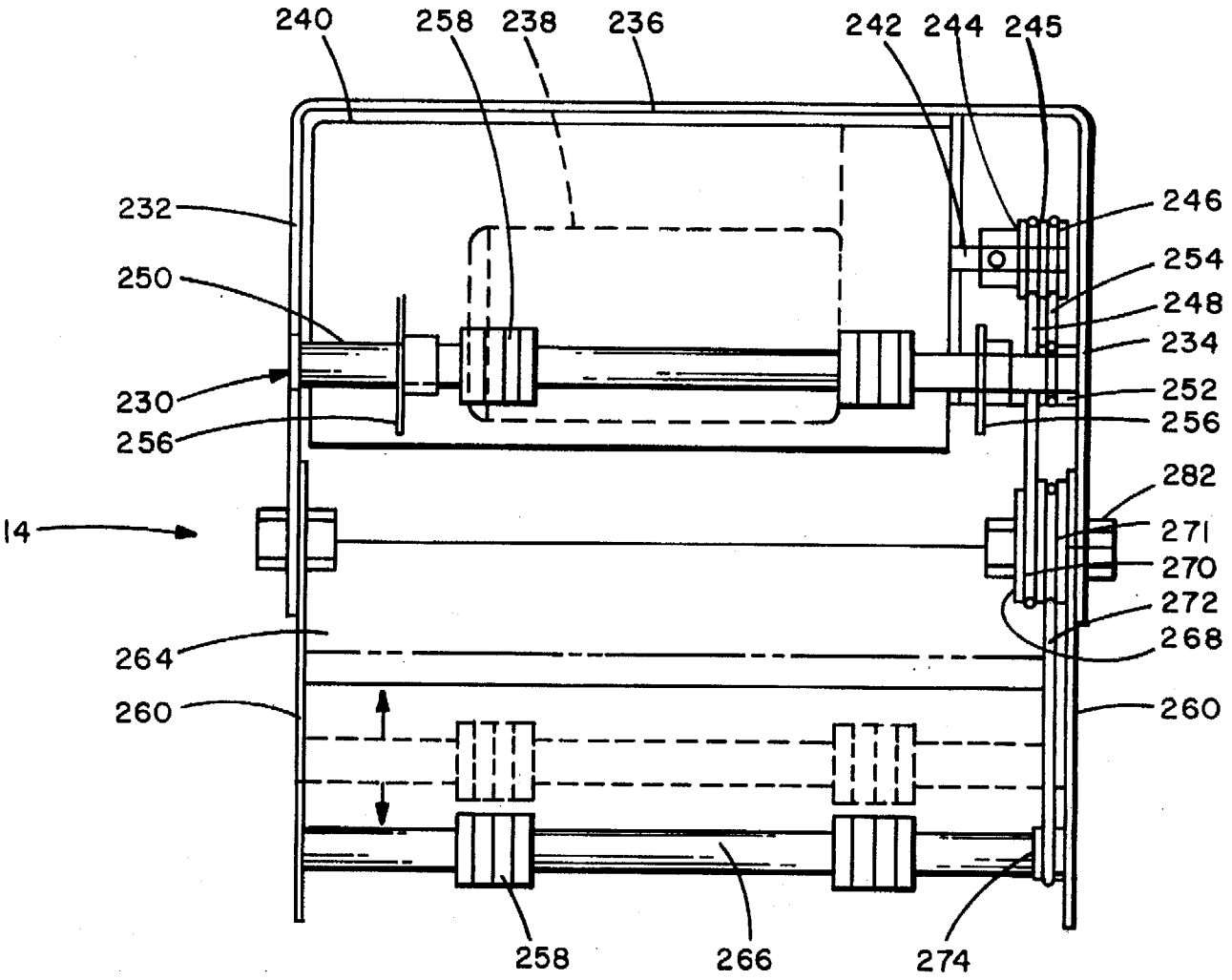
FIG. 8 is a top plan view of the label applicator unit of FIG. 1 with the container not illustrated.
Figure 9:
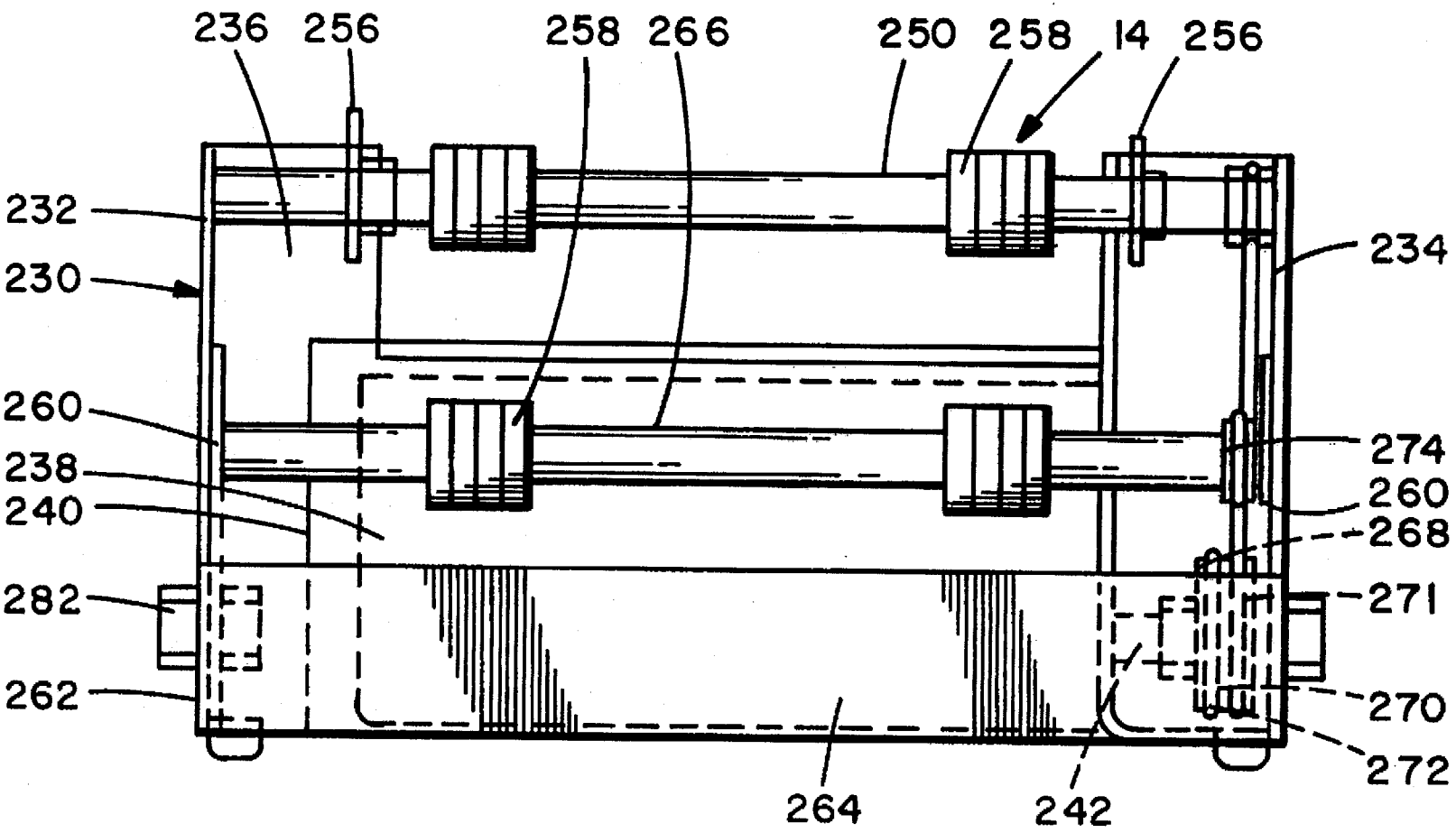
FIG. 9 is a front elevation view of the label applicator unit of FIG. 8.

As best seen in FIGS. 8 and 9, the label applicator unit 14 has a frame structure 230 with upstanding left and right side plates 232 and 234 interconnected by a plate 236. A variable speed drive motor 238 is mounted to the left side plate 232 between the left and right side plates 232 and 234. A drive shaft 242 extends from the drive motor 238 and extends through the right side of a motor housing 240 covering the motor. The drive shaft 242 has a rear double drive sheaf 244 at its end that rotates with the drive shaft. The rear double drive sheaf 244 includes a pair of spaced annular grooves 295 and 246 that receive inner and outer drive belts 248 and 254 that drive rear and forward spinner shafts 250 and 266 of the label applicator unit 14, which are positioned to rotatably support the container 26 therebetween.

The rear spinner shaft 250 is rotatably carried by the left and right side plates 232 and 234 above the drive motor 238. The rear spinner shaft 250 has a single drive sheaf 252 spaced above the double drive sheaf 244 with the outer drive belt 254 extending between the sheaves. The single device sheaf 252 receives the outer drive belt 254 such that rotation of the drive shaft 242 is transmitted to the rear spinner shaft 250 by the drive belt 254 thereby causing the rear spinner shaft to rotate about its axis. As indicated above, the drive motor 238 is a variable speed motor such that the speed at which the drive shaft 242 rotates can be controlled, thereby controlling the speed at which the rear spinner shaft 250 rotates.

The rear spinner shaft 250 has a pair of adjustable guide members 256 that retain the container 26 (not shown) in a desired location relative to the dispensing station 23 (FIG. 7). The adjustable guide members 256 are movably adjustable axially along the rear spinner shaft 250. Rubber tings 258 are positioned on the rear spinner shaft 250 and are located to frictionally engage the container being rotated to prevent slipping of the container on the rear spinner shaft during the label application process.

The label applicator unit 14 also includes a pair of support pivot arms 260 adjustably connected to the lower front portion 262 of the frame structure 230 and interconnected by a front plate 264 extending between the support pivot arms. A forward spinner shaft 266 extends between the outer ends of the support pivot arms 260 and is rotatably attached to the support pivot arms such that the forward spinner shaft is substantially parallel to the rear spinner shaft 250. The forward and rear spinner shafts 266 and 250 are adjustably spaced apart to support the container 26 thereon adjacent to the dispensing station 23, as is illustrated in FIG. 7.

A forward double drive sheaf 268 spaced apart from the rear double drive shaft 244 is rotatably attached to the frame 230 at its intersection with the bottom of the right support pivot arm 260. The forward double drive sheaf 268 has inner and outer annular grooves 270 and 271 therein that are substantially aligned with the annular grooves 246 in the rear double drive sheaf 244. The forward double drive sheaf 268 is rotated by an inner drive belt 272 extending between the forward and rear double drive sheaves and positioned in the inner annular grooves 245 and 270 of the rear double drive sheaf and the forward double drive, respectively. An outer drive belt 273 is positioned in the outer annular groove 271 in the forward double drive sheaf 268 and extends to the forward spinner shaft 266 and engages a forward single spinner sheaf 274. Accordingly, the forward double drive sheaf 268 is rotated about its axis by the inner drive belt 248, which in turn moves the outer drive belt 273 and rotates the forward spinner shaft 266. The forward and rearward double drive sheaves 268 and 244 have approximately the same diameter, and the forward and rear single spinner sheaves 274 and 252 have approximately same diameter such that the forward and rear spinner shafts 266 and 250 are driven by the drive motor at substantially the same rotational speed to smoothly rotate the container being labeled that is supported by the forward and rear spinner shafts.

The forward spinner shaft 266 also has a plurality of robber rings 280 thereon that provide frictional engagement with the container. Accordingly, the container 26 shown in FIG. 7 is smoothly and easily rotated by the label applicator unit 14 without slipping as the label 16 is moved over the dispensing ramp 24 and presented to the moving container.

The support pivot arms 260 are pivotal about an axis extending through the forward double drive sheaf 268 such that the distance between the forward and rear spinner shafts 266 and 250 can be increased or decreased to accommodate containers having different sizes. The support pivot arms 260 are positioned such that the forward spinner shaft 266 is farther away from the rear spinner shaft 250, as shown in solid lines in FIG. 8, to support a container having a larger diameter, and the support pivot arms are positioned with the forward spinner shaft closer to the rear spinner shaft for containers having a smaller diameter, as is illustrated in phantom lines in FIG. 8.

The support pivot arms 260 are connected to the frame structure 230 by tightenable fasteners 282 extending through the bottom portions of the support pivot arms 268 such that the support pivot arms can be releasably locked in a selected position. If the position of the support arms 260 and the forward spinner shaft 266 is to be changed, the tightenable fasteners 282 are simply loosened, the support pivot arms pivoted and the forward spinner shaft moved to the desired location and the fasteners retightened.

In the preferred embodiment, the label applicator unit 14 is positioned forwardly of the label dispenser unit 12, as is illustrated in FIGS. 1 and 7, and the support pivot arms 260 are positioned so the container 26 is rotatably supported forwardly adjacent to the dispensing ramp 24. The pressure bar assembly 208 lightly engages the label surface 292 of the container 26 with gravity pressing the pressure bar 216 against the container. In this position, the container 26 is rotated by activating the drive motor 238. The speed of the forward and rear spinner shafts and the resulting rotational speed of the container 26 is controlled by adjusting the speed of the drive motor such that the rotational speed of the container substantially corresponds to the speed at which the label 16 is being lifted and dispensed from the dispensing station 23 of the conveyor assembly 22.

As the label 16 extends upwardly and forwardly over the dispensing ramp 24 the adhesive side of the label is presented to and lightly adhered to the label surface 292 of the container 26. The pressure sensitive adhesive on the label 16 is pressed into secure engagement on the container 26 when the label moves under the pressure bar 216. After the label 16 has been adhered to the container 26, the container is removed from the label applicator unit 14 by pulling it off of the forward and rear spinner shafts 266 and 250, which causes the pressure bar 216 to slightly lift relative to the bar support arms 214 such that the axle 218 of the pressure bar moves along the length of the slot. After the labeled container the label a removed, a new container 26 may be placed on the label applicator unit 14 for labeling.

In the preferred embodiment, the drive motor assembly 146 of the label dispensing unit 12 includes a foot switch or other suitable motor activating switch that allows a user to control activation of the drive motor, thereby controlling the rate at which labels are dispensed from the dispensing station 190 onto a selected container. In an alternate embodiment, the foot switch is configured as a brake mechanism to interrupt the flow of the labels along the conveyor assembly 22 and to temporarily stop the label dispensing unit.

In the preferred embodiment, the drive motors 149 and 238 of the label dispensing unit 12 and the label applicator unit 14 are independently controlled, although the motors can be coupled together such that the motors provide synchronous motion between the conveyor assembly 22 and the label applicator unit for continuous, smooth labeling of selected containers.

Numerous modifications and variations of the label dispenser and applicator assembly disclosed herein will occur to those skilled in the art in view of this disclosure. For example, the label applicator unit can be integrally connected to the label dispensing unit. Further, the drive belt arrangement may be modified, such as between the pinch rollers so a single drive belt extends to the bottom pinch roller and drives the conveyor assembly. Therefore, it is to be understood that such modifications and variations may be practiced while remaining within the spirit and the scope of the invention as defined by the following claims.

I claim:

1. A label dispenser for stripping adhesive backed labels from an elongated backing strip unwound from a roll of labels that includes a plurality of labels removably adhered to a backing strip that has a leading end and for dispensing the removed labels for adherence to predetermined units, comprising:

a frame a take-up reel rotatable relative to said frame, said take-up reel securely retaining the leading end of said backing strip and being positioned to take-up portions of the backing strip;

a reel drive operatively connected to said take-up reel to rotate said take-up reel such that portions of the backing strip is taken up by said take-up reel;

a roll support attached to said frame away from said take-up reel with a length of backing strip extending therebetween along a strip pathway, said roll support shaped to securely retain the roll of labels thereon, said roll support and the roll of labels being rotatable as a unit relative to said frame, said roll support being rotated when said take-up reel is rotated and the backing snip is taken-up by said take-up reel;

a tensioning member connected to said roll support that resists rotation of said roll support and provides tension in the length of backing strip extending along the strip pathway;

a pinch roller rotatably connected to said frame away from said roll support, said pinch roller being positioned to receive thereon the portion of the backing strip extending along the strip path, said pinch roller being rotatable by the backing strip when the backing strip is moved along the strip pathway toward said take-up reel, said pinch roller having a drive belt receiving member thereon;

a label separator attached to said frame, said label separator having a stripping edge positioned to receive the backing strip and labels thereover when said take-up reel takes up the backing strip, and to strip the labels off the backing strip as each label passes over said stripping edge, said stripping edge being positioned away from said take-up reel such that the backing strip is pulled over said stripping edge;

a label conveyor having a pick-up station adjacent to said stripping edge of said label separator and a dispensing station away from said pick-up station, said label conveyor having an endless conveyor belt movable around first and second conveyor sheaves with a top portion of said conveyor being movable from said pick-up station toward said dispensing station, said label conveyor having drive belt receiving portions; and a drive belt extending between said drive belt receiving member of said pinch roller and said drive belt receiving portion of said label conveyor, said drive belt being movable upon rotation of said pinch roller by moving the backing strip over said pinch roller, thereby causing said drive belt to move said label conveyor.

2. The label dispenser of claim 1 wherein said label conveyor has a label remover at said dispensing end, said label remover having a sloped ramp extending above the conveyor belt and positioned to direct a label upwardly off of said conveyor belt with an adhesive layer being exposed and presented for attachment onto a unit.

3. The label dispenser of claim 2 wherein said label remover is a discharge sheaf having elevated cheeks that define an annular channel having said conveyor belt therein, said elevated cheeks having a top surface above said conveyor belt.

4. The label dispenser of claim 1 wherein said pinch roller is a first pinch roller, and further comprising a second pinch roller adjacent to said first pinch roller rotatably connected to said frame, said frame having opposing slots therein and said first pinch roller has an axle movably positioned within said slots, said first pinch roller being movable along the length of said slots and being positioned in engagement with said second pinch roller.

5. The label dispenser of claim 1, further comprising a compression bar movable relative to said conveyor and positioned to engage a label moving off of said conveyor belt and to exert a compression force on the label.

6. The label dispenser of claim 1 wherein said label separator is pivotally attached to said frame with said separator edge being movable between a plurality of angular orientations relative to said pickup station of said label conveyor.

7. The label dispenser of claim 1, further comprising an applicator unit adjustably positioned adjacent to said discharge station of said label conveyor, said applicator unit having support portions that removably receive the unit being labeled and that move a label surface of the unit past said discharge station when the label is partially extending upwardly and outwardly upon moving over said discharge end of said conveyor to adhere the label to the label surface of the unit.

8. The label dispenser of claim 1 wherein said tensioning member is adjustable to increase or decrease the tension on the length of the backing material extending between the support roll and said separating edge.

9. The label dispenser of claim 1 wherein said reel drive is a variable speed drive having a speed adjustment to control the speed of said real drive, thereby controlling the speed of said label conveyor and the rate at which the labels are stripped from the backing strip.

10. A label dispenser for stripping labels from an elongated backing strip and dispensing the labels, comprising:

a frame;

a backing strip takeup member carried by said frame;

a reel drive operatively connected to said takeup member to move said takeup member relative to said frame;

a label separator attached to said frame and positioned away from said takeup member to receive the backing strip and labels and to cause the label to be peeled from the backing strip;

a pinch roller rotatably supported by said frame away from said label separator, said pinch roller being positioned to movably receive the backing strip thereon;

a roller support member carried by said frame and positioned to receive a roll of labels comprised of the elongated backing strip and a plurality of labels adhered thereto, said roll support providing adjustable resistance to movement of the backing strip and labels away from the roll of labels; and a conveyor assembly having a label pickup station adjacent to said label separator and a label dispensing station away from said label separator, said conveyor assembly having a conveyor extending between said pickup station and said dispensing station and being positioned to receive the labels thereon after the labels are stripped from the backing material, said conveyor assembly having a drive belt operatively connected to said conveyor and to said pinch roller to move said conveyor between said pickup and dispensing stations, said conveyor assembly having a label remover at said dispensing station adjacent to said conveyor, said label remover having a ramp portion extending upwardly away from said conveyor belt and being positioned to lift a lead portion of the label off of the conveyor and to direct the lead portion of the label away from said conveyor with a backside with an adhesive side of the label being exposed and presented for dispensing from said conveyor assembly.

11. The label dispenser of claim 10 wherein said label remover is a conveyor sheaf having elevated cheeks that define an annular channel having said conveyor belt therein, said elevated cheeks having a top surface above said conveyor belt.

12. The label dispenser of claim 10, further comprising a pressure bar movable relative to said conveyor and positioned to engage a label moving off of said conveyor belt.

13. The label dispenser of claim 10 wherein said label separator is pivotally attached to said frame with said separator edge being movable between a plurality of angular orientations relative to said pickup station of said label conveyor.

14. The label dispenser of claim 10 wherein said takeup member and said label separator are pivotally coupled to said frame and are each pivotal between a plurality of angular orientations relative to said conveyor assembly.

15. The label dispenser of claim 10, further comprising an applicator unit adjustably positioned adjacent to said discharge station of said label conveyor, said applicator unit having support portions that removably receive the unit being labeled and that move a label surface of said unit past said discharge station when the label is partially extending upwardly and outwardly upon moving over said label remover to adhere the label to the label surface of the unit.

16. The label dispenser of claim 15 wherein said applicator unit further includes an applicator frame, at least one of said support portions being movable relative to said applicator frame and a variable speed support drive coupled to said support portions to move said movable support portion, thereby moving the label surface of said unit past said dispensing station.

17. A label dispensing machine for use with a roll of backing tape having labels with pressure sensitive adhesive on their backside detachably adhering to a release coating on the front side of the backing tape, said machine comprising:

a label releasing bar having a front edge;

a tape dispensing mechanism for moving tape from a said roll forwardly over said bar and then rearwardly beneath said bar so that labels on the tape are released therefrom at said front edge as the tape passes thereover;

a conveyor forwardly of said bar and adjacent thereto for moving said labels forwardly in succession as they are released from the backing tape, said conveyor including laterally-spaced narrow endless belts having a forwardly moving upper run for supporting the labels with the adhesive on the backside of the labels only slightly adhering to the belts, said upper run passing over front sheaves having annular grooves receiving said belts and annular cheeks at the sides of the grooves with rims of a material to which said adhesive has substantially no adherence, said rims extending above the level of the top of said upper run so that conveyed labels on said upper run are pushed by the belts over said rims as they advance, thereby releasing the labels from said upper run and progressively exposing the backside of the labels forwardly of the front sheaves so that objects to be labeled can be wiped in succession upwardly into adhering engagement with the adhesive on the exposed backside of the labels as the labels progress over said rims.

18. A label dispensing machine for use with a roll of backing tape having labels with pressure sensitive adhesive on their backside detachably adhering to a release coating on the front side of the backing tape, said machine comprising:

a label releasing bar having a front edge;

a tape dispensing mechanism for moving tape from a said roll forwardly over said bar and then rearwardly beneath said bar so that labels on the tape are released therefrom at said front edge as the tape passes thereover, said tape dispensing mechanism including an upper take-off roller for holding a roll of tape, an intermediate pair of pinch rollers for guiding the tape from the take-off roller to the label releasing bar, and a powered take-up roller to the rear of the label releasing bar for advancing the tape by winding it on the take-up roller;

a conveyor forwardly of said bar and adjacent thereto for moving said labels forwardly in succession as they are released from the backing tape, said conveyor including laterally spaced narrow endless belts having a forwardly moving upper run for supporting the labels with the adhesive on the backside of the labels only slightly adhering to the belts, said upper run passing over front sheaves having annular grooves receiving said belts and annular cheeks at the sides of the grooves with rims of a material to which said adhesive has substantially no adherence, said rims extending above the level of the top of said upper run so that conveyed labels on said upper run are pushed by the belts over said rims as they advance thereby releasing the labels from said upper run and progressively exposing the backside of the labels forwardly of the front sheaves so that objects to be labelled can be wiped in succession upwardly into adhering engagement with the adhesive on the exposed backside of the labels as the labels progress over said rim, one of said pinch rollers having a belt drive to said conveyor, said pinch rollers being driven by engagement with the tape.

19. A machine according to claim 18 in which a pressure roller is adjustably positioned above and forwardly of said front sheaves for engagement by said objects and labels as the objects are wiped into engagement with the adhesive on the backside of the labels.

20. A machine according to claim 19 in which a pair of adjustable spin rollers are located beneath said pressure roller adjacent the forward end of said conveyor for rotating a round object while held in engagement with the backside of a label advancing from said conveyor by said pressure roller and spin rollers.

21. A machine according to claim 19 in which said tape dispensing mechanism and one of said spin rollers are independently powered by respective variable speed motors.

22. A machine according to claim 18 in which said belts have a circular cross-section with a diameter about one-eighth of an inch.

23. A machine according to claim 18 in which said bar is swing mounted to change the angle of said front edge of the bar relative to the tape from the roll.

24. A machine according to claim 18 in which said tape dispensing mechanism includes an upper take-off roller for holding a roll of tape, an intermediate pair of pinch rollers for guiding the tape from the take-off roller to the label releasing bar, and a powered take-up roller to the rear of the label releasing bar for advancing the tape by winding it on the take-up roller.

25. A machine according to claim 24 in which an adjustable speed motor is coupled to said take-up roller.

26. In a label dispensing machine, a conveyor for moving labels with pressure sensitive adhesive on their backside forwardly in succession, said conveyor including laterally-spaced narrow endless belts having a forward moving upper run for supporting the labels with said adhesive only slightly adhering to the belts, said upper run passing over front sheaves having annular grooves receiving said belts and having ramps at the sides of the grooves of a material to which said adhesive has substantially no adherence, said ramps extending above the level at the top of said upper run so that conveyed labels on said upper run are pushed by the belts over said ramps as they advance, thereby releasing the labels from the upper run and exposing the backside of the labels forwardly of the ramps.

27. In a label dispensing machine according to claim 26, said ramps comprising annular cheek plates on said front sheaves.

* * * * *

UNITED STATES PATENT AND TRADEMARK OFFICE

CERTIFICATE OF CORRECTION

PATENT NO. : 5,674,350

DATED : October 7, 1997

INVENTOR(S) : Donald Jurgich

It is certified that error appears in the above-indentified patent and that said Letters Patent is hereby corrected as shown below:

Column 14, Line 11, delete "snip" and insert --strip--.

Signed and Sealed this

Thirty-first Day of March, 1998

*Attest:*

Bruce Lehman

BRUCE LEHMAN

*Attesting Officer*

*Commissioner of Patents and Trademarks*